US006134973A

United States Patent [19]

Schoeps

[11] Patent Number: 6,134,973

[45] Date of Patent: Oct. 24, 2000

[54] METHOD FOR DETERMINING THE INSTALLED TORQUE IN A SCREW JOINT AT IMPULSE TIGHTENING AND A TORQUE IMPULSE TOOL FOR TIGHTENING A SCREW JOINT TO A PREDETERMINED TORQUE LEVEL

[75] Inventor: Knut Christian Schoeps, Tyresö, Sweden

[73] Assignee: Atlas Copco Tools AB, Nacka, Sweden

[21] Appl. No.: 09/178,999

[22] Filed: Oct. 26, 1998

[30] Foreign Application Priority Data

Oct. 27, 1997 [SE] Sweden ..... 9703896

[51] Int. Cl.[7] ..... B24B 23/14

[52] U.S. Cl. ..... 73/862.23; 173/183

[58] Field of Search ..... 73/761, 862.23, 73/862.24; 173/180, 181, 183

[56] References Cited

U.S. PATENT DOCUMENTS

| | | | |
|---|---|---|---|
| 4,161,220 | 7/1979 | Carlin et al. | 173/1 |
| 4,316,512 | 2/1982 | Kibblewhite et al. . | |
| 4,361,945 | 12/1982 | Eshghy | 29/407.03 |
| 5,366,026 | 11/1994 | Maruyama et al. . | |
| 5,519,604 | 5/1996 | Hansson | 364/148 |

*Primary Examiner*—Max Noori

*Attorney, Agent, or Firm*—Frishauf, Holtz, Goodman, Langer & Chick, P.C.

[57] ABSTRACT

A basic method is provided for determining the installed torque in a screw joint which is being tightened by a series of repeated torque impulses. The rotational movement of the screw joint is detected during each impulse. The point in which the screw joint ceases to rotate is detected. And the actually applied torque is indicated at the very instance the screw joint ceases to rotate. In a tightening process control application of the above described basic method, the per impulse increasing value of the installed torque is compared to a predetermined target value in a way known per se, and the tightening process is interrupted as the target value is reached. In a tightening process quality check application of the above described basic method, the accomplished angular displacements of the joint at repeated impulses are indicated and added, and high and low limit values for the final installed torque and the total angle of rotation are provided and compared to the actually obtained values. A torque impulse delivering power tool employing the above-described basic method, moreover, includes an impulse generator (12) with an output shaft (13) having a torque transducer (23) and a rotation detecting device (24) both connected to a process control unit (33) in which a device is arranged to provide a torque target value and a comparing circuit is provided to compare the actual value of the installed torque with the target value and to initiate shut-off of the power supply to the power tool as the target value is reached.

3 Claims, 3 Drawing Sheets

METHOD FOR DETERMINING THE INSTALLED TORQUE IN A SCREW JOINT AT IMPULSE TIGHTENING AND A TORQUE IMPULSE TOOL FOR TIGHTENING A SCREW JOINT TO A PREDETERMINED TORQUE LEVEL

BACKGROUND OF THE INVENTION

The invention relates to a method and a device for tightening screw joints by the application of a number of succeeding torque impulses. In particular, the invention concerns a method which is intended for controlling and quality checking of impulse tightening processes and which is based on the determination of the installed torque in the screw joint at each one of the applied torque impulses.

A problem concerned with prior art techniques in this field is the difficulty to obtain an accurate measurement of the installed torque and, hence, an accurate final tightening level in the screw joint based on such measurement. One of the reasons behind this problem used to be the lack of reliable torque transducers suitable for torque impulse tools. Although the transducer problem nowadays has been solved, the accuracy problem as regards the installed torque measurement still exists.

Accordingly, in previously described screw joint tightening methods using torque impulse tools, as described for instance in U.S. Pat. No. 5,366,026, the torque delivered by the tightening tool is used for determining the pretension level in the screw joint. The actual torque level during the tightening process has always been determined by measuring the peak values of the delivered torque impulses, and the tightening process has been controlled by comparison of the per impulse increasing peak value with a predetermined value corresponding to a desired tension level in the screw joint.

This previously described tightening control method, however, still suffers from accuracy problems. One of the reasons is that the torque peak value indicated at each delivered impulse does not correctly reflect the true actual tension level in the screw joint. After a thorough study of the torque impulse application on screw joints, it has been established that the peak of a delivered torque impulse occurs at the beginning of the torque pulse, and that the screw joint continue to rotate over a further angular distance after that. When the screw joint actually stops rotating, the torque level is in fact substantially lower than the indicated peak value. Since the tension in the screw joint via the pitch of the thread corresponds directly to the angular displacement of the screw, the tension increases as long as the screw joint rotates.

Accordingly, the above mentioned study showed that the screw joint is tightened over a further angular distance after the torque peak has occurred, and that the actual screw tension in a vast majority of cases corresponds to a considerably lower torque level than the indicated peak level. Hence, the indicated peak torque level is not the same as the installed torque and does not truly reflect the tension in the screw joint. Accordingly, it is not useful as a process control measurement.

The primary object of the invention is to improve the accuracy of impulse tightening of screw joints by obtaining a more accurate measurement of the installed torque in the screw joint.

Another object of the invention is to accomplish an improved method for controlling a screw joint tightening process by using the new improved method for measuring the installed torque in the screw joint.

A still further object of the invention is accomplish an improved method for quality checking the end result of a screw joint tightening process by using the installed torque measurement in accordance with the new method as well as a measurement of the total angular movement of the joint.

Further objects and advantages of the invention will appear from the following detailed description of a preferred embodiment of the invention with reference to the accompanying drawings.

BRIEF DESCRIPTION OF THE DRAWINGS

FIGS. 5*a* and 5*b* as well as 6*a* and 6*b* illustrate, similarly to FIGS. 3*a* and 3*b* the rotational movement of the screw joint during two still later impulses during the same tightening process, whereas

DETAILED DESCRIPTION

Figures 1, 2:
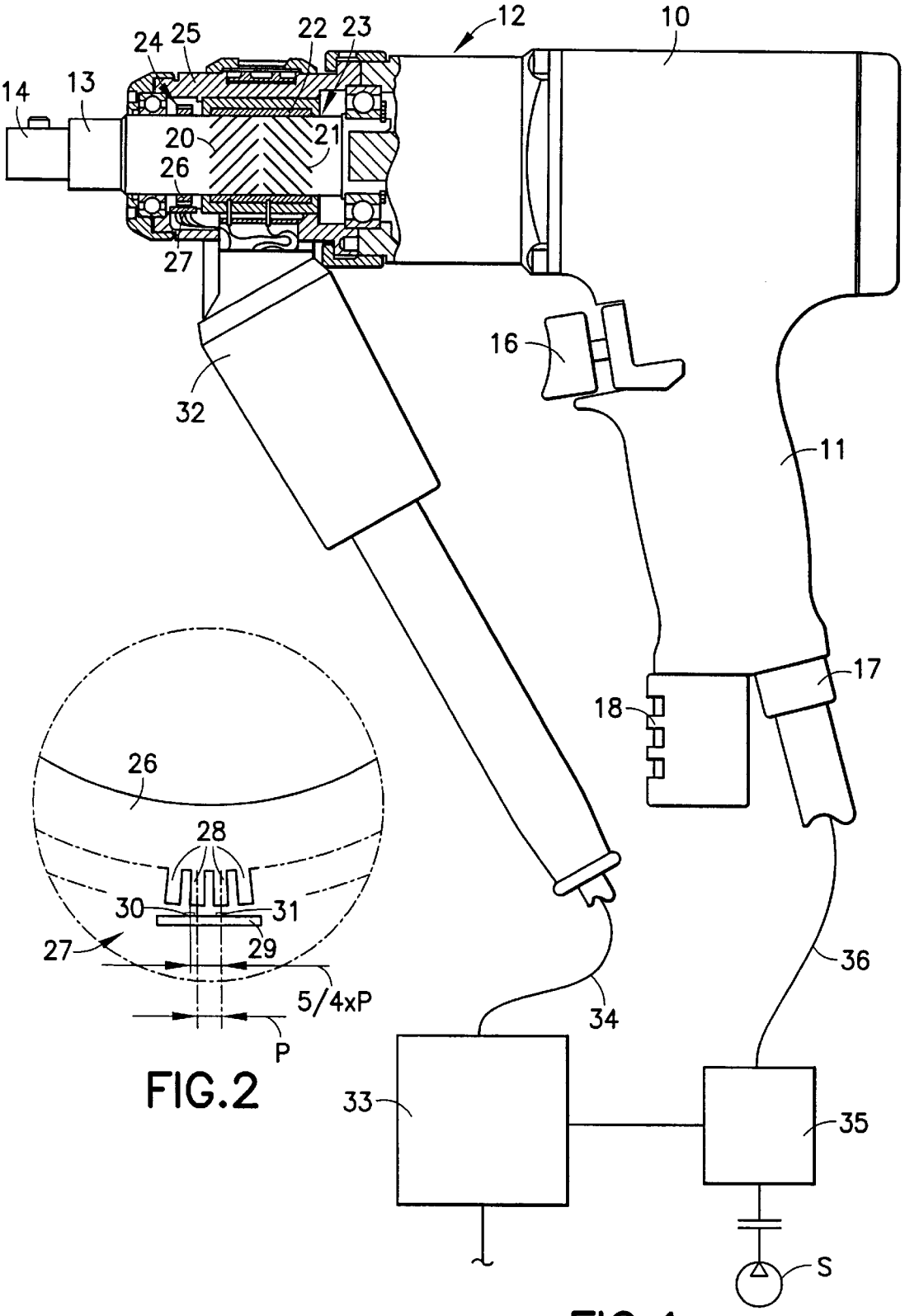
FIG. 1 shows a side view, partly in section, of a torque impulse delivering tool according to the invention connected to a power supply and process control unit.
FIG. 2 illustrates schematically, on a larger scale, a fraction of a rotation detecting and angle measuring device comprised in the tool in FIG. 1.

The torque impulse tool shown in FIG. 1 comprises a housing 10 with a pistol type handle 11, a pneumatic rotation motor (not shown) located in the housing 10, a hydraulic impulse generator 12 connected to the motor, and an output shaft 13 connected to the impulse generator 12. The output shaft 13 is provided with an outer square end 14 for attachment of a nut socket or the like. The handle 11 includes in a common way air inlet and outlet passages (not shown) and is provided with a throttle valve 16 as well as a pressure air conduit connection 17 and an exhaust air deflector 18.

The output shaft 13 is made of a magneto-strictive material and has two circumferential arrays of recesses 20 and 21 which together with a coil assembly 22 form a torque sensing unit 23. This type of torque sensing unit is previously known per se, for instance through the above mentioned U.S. Pat. No. 5,366,026, and does not form any part of the invention.

Further, the tool is provided with a rotation detecting device 24 of the magnetic sensor type which comprises a ring element 26 secured to the output shaft 13 and a sensing unit 27 mounted in the front section 25 of the housing 10. The ring element 26 has a circumferential row of radial teeth 28 disposed at a constant pitch. The sensing unit 27 is located right opposite the ring element 26 and comprises two sensing elements 30,31 which are arranged to generate electric signals in response to their relative positions visavi the teeth 28.

By the rotation detecting device 24 it is also possible to obtain information of the amount of angular displacement $\phi$ of the output shaft 13. This is useful for performing a quality check of the end result of the tightening process. Thereby, limit values for the final torque and the total angle of rotation are checked against the actual installed torque and angular displacement measured at the end of the tightening process.

As illustrated in FIG. 2, the sensing elements 30,31 are integrated in a printed circuit board 29 and are disposed side by side at a distance equal to 5/4 of the pitch of the teeth 28. The purpose of such a spacing of the sensing elements 30,31 is to obtain a 90° phase displacement of the signals reflecting the angular displacement of the output shaft 13. This makes it easier to safely determine the rotational movement of the shaft 13. Alternatively, the sensing elements 30,31 may be spaced 1/4 or 3/4, 5/4, 7/4 etc. of the tooth pitch.

However, the rotation detecting device 24 is previously known per se and does not form any part of the invention. This type of devices is commercially available and is marketed by companies like Siemens AG.

The torque sensing unit 23 as well as the rotation detecting device 24 are both connected to a process control unit 33 via a multi-core cable 34 which is connected to the tool via a connection unit 32. The control unit 33 comprises means for setting a desired target value for the installed torque in the screw joint as well as limit values for the final torque and the total angle of rotation. The control unit 33 also contains a comparing circuit for comparing the actual torque value with the set target value, and a circuit for initiating shut-off of the motor power as the actual torque equals the set target value.

The process control unit 33 is connected to a power supply unit 35 which is incorporated in a pressure air conduit 36 connected to the impulse tool and arranged to control the air supply to the motor of the tool. The power supply unit 35 is connected to a pressure air source S.

The electronic components and circuitry of the control unit 33 are not described in detail, because they are of a type commonly used for power tool control purposes. For a person skilled in the power tool control technique, there would not be required any inventive activity to build a control unit once the desired specific functional features are defined. The invention defines those functional features as a method for determining the installed torque in a screw joint being tightened by repeated torque impulses as well as application methods for controlling and monitoring a torque impulse tightening process.

The functional features of the methods according to the invention and the operation order of the impulse tool during a tightening process including a number of successive torque impulses delivered to a screw joint are illustrated by the diagrams 3*a–c* to 6*a–c*. These diagrams are plotted from measurements made during a real tightening process. The diagrams show signals representing the rotational movement of the screw joint as well as measurements representing the torque delivered to the joint and the clamping force or tension magnitude obtained in the joint during four different impulses representing four different tightening stages of the same tightening process.

Figure 3A:
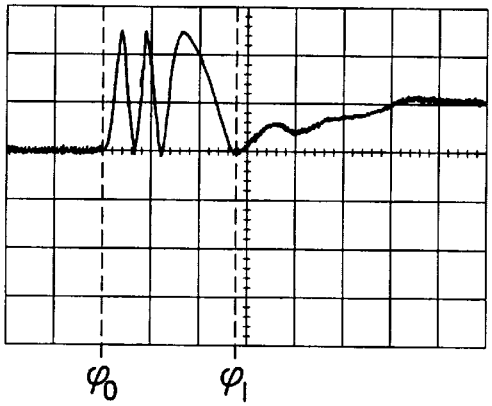
FIGS. 3*a* and 3*b* illustrate the rotational movement of the tightening tool output shaft during one discrete impulse as indicated by two separate sensing elements disposed at a relative phase displacement of 90°.
Figure 4A:
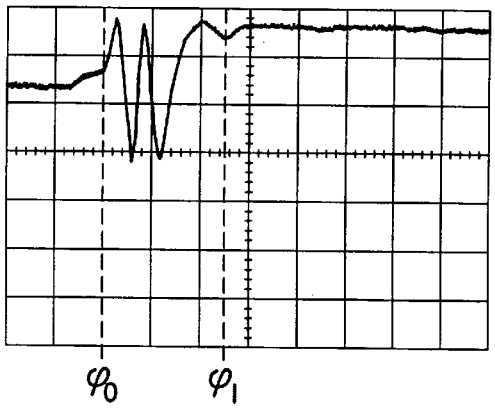
FIGS. 4*a* and 4*b* illustrate, similarly to FIGS. 3*a* and 3*b*, the rotational movement of the screw joint during another later impulse.
Figure 3B:
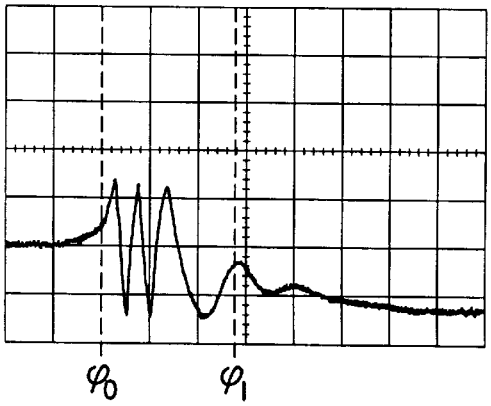
Figure 4B:
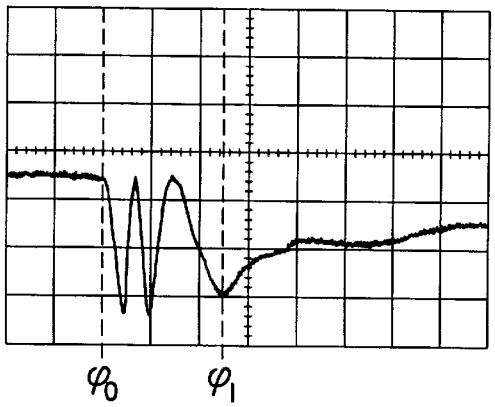
Figure 3C:
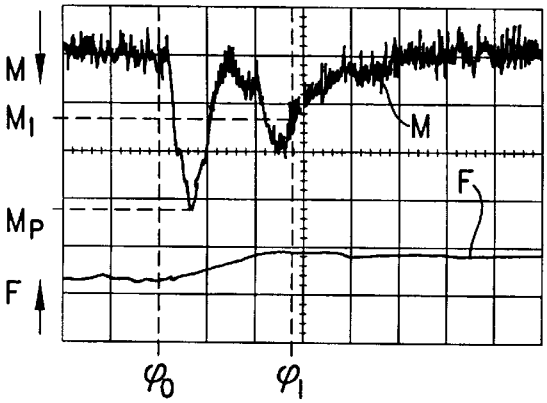
FIG. 3*c* illustrates in relation to time the torque delivered to a screw joint as well as the tension obtained during one discrete torque impulse.
Figure 4C:
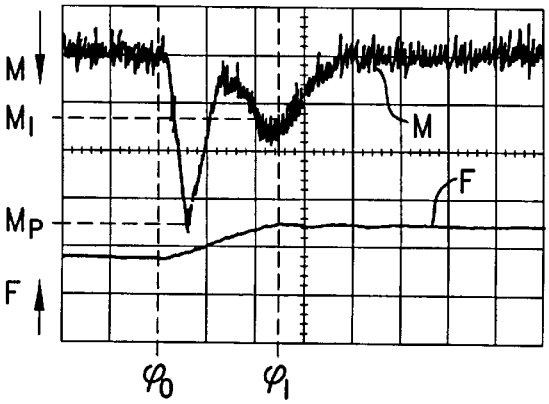
FIG. 4*c* shows, similarly to FIG. 3*c*, the actual torque and tension development in relation to time at a later torque impulse during the same tightening process.
Figure 5A:
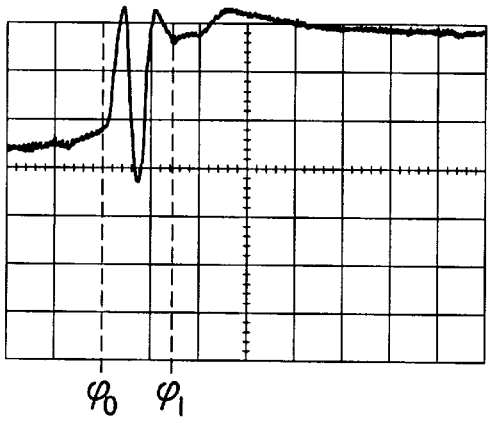
Figure 6A:
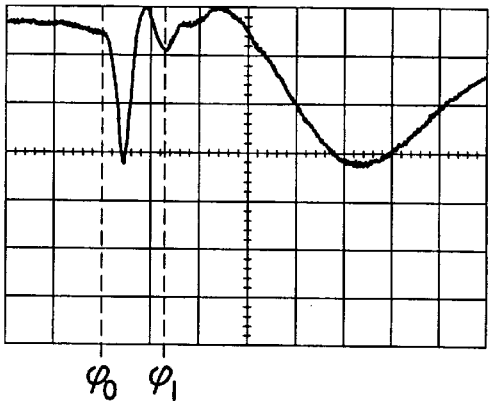
FIGS. 5*c* and 6*c* show the actual torque and tension development in relation to time during the impulse related angular movements illustrated in FIGS. 5*a* and 5*b* and 6*a* and 6*b*, respectively.
Figure 5B:
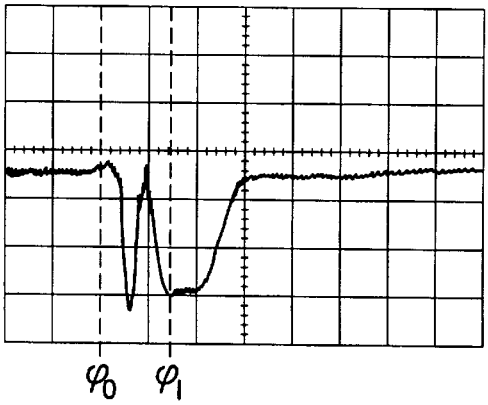
Figure 6B:
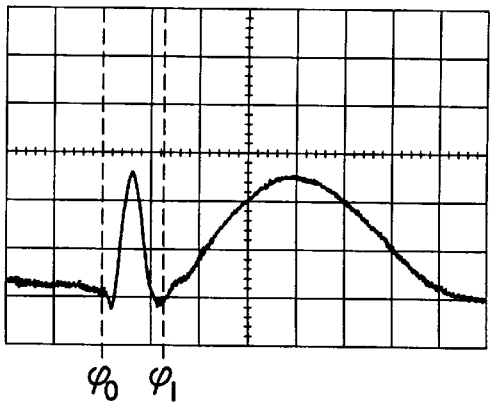
Figure 5C:
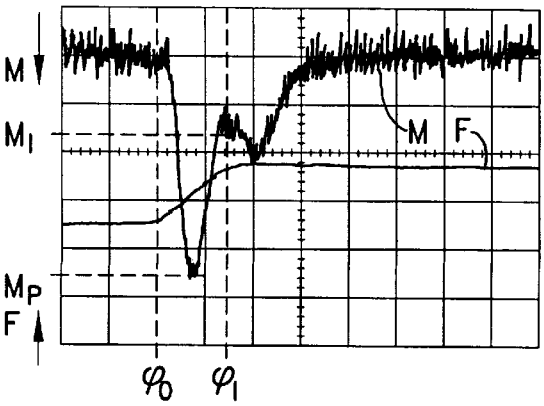
Figure 6C:
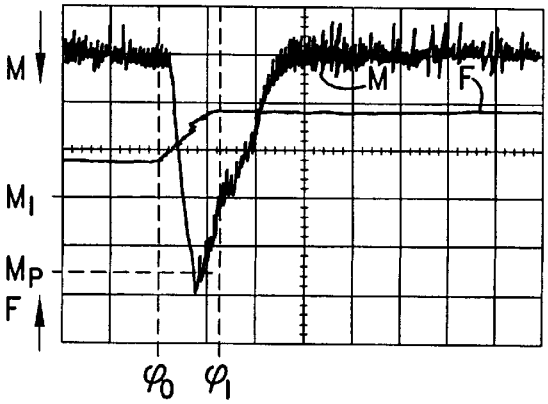

The first one of the described impulses delivered to the joint is illustrated in FIGS. 3*a–c*. In FIG. 3*a*, there is shown the rotation related signal delivered by one of the sensing elements 30,31, and FIG. 3*b* show the rotation related signal delivered by the other one of the sensing elements 30,31. The diagrams show the rotation signal in relation to time, and the wave formed curves reflect the magnetic influence of a succession of teeth 28 passing by the sensing elements 30,31 at rotational movement of the output shaft 13.

By studying these curve forms, it is quite easy to determine where the rotation of the joint starts and stops during the impulse. Starting from the left, the curve is straight horizontal. This represents the stand still condition before the rotation starts. The rotation starts at $\phi_0$, and after a certain increment of rotation illustrated by the repeated wave forms, the rotation stops at $\phi_I$. At this instance, the wave form of the curve does no longer reach its full amplitude. This is clearly illustrated in FIG. 3*b*. In FIG. 3*a*, this stop of rotation occurs in one of the inflexion points of the curve and is not possible to determine with certainty whether a stop of rotation actually has taken place. Due to the 90° phase displacement of the sensing elements 30,31, it is always possible to obtain a clear indication of a rotation stop by comparing the two curves.

It should be noted that the output shaft 13 does not come to a complete standstill condition after the stop position $\phi_I$ has been reached, which is indicated by the curves in FIGS. 3*a* and 3*b* not being straight horizontal after that position. The reason for that is a slight rebound movement of the output shaft 13 which however does not influence the stop position of the joint.

As described above, the screw joint position at the end of the accomplished rotational increment is marked with $\phi_I$ and has a corresponding location in all three diagrams 3*a–c*.

In the diagram shown in FIG. 3*c*, there are illustrated both a signal representing the torque M delivered to the screw joint and a signal representing the obtained clamping force or tension F in the joint. The clamping force F is obtained from a sensor mounted directly on the screw joint. This arrangement is used for experimental purposes only, because if you always have access to the actual clamping force in the joint during tightening the new method for obtaining a more accurate measurement of the installed torque would be meaningless. Accordingly, the clamping force sensor is used just for obtaining a diagrammatical illustration of the tension increase during each impulse, particularly when illustrated in a direct comparison with the torque/time curve.

It is to be observed that the torque curve is plotted with an increasing torque directed downwards, whereas the tension curve is shown with increasing magnitudes directed upwards. See arrows to the left of the diagram in FIG. 3*c*.

From the diagram in FIG. 3*c* it is evident that the screw joint position $\phi_I$ does not coincide with the position in which the peak value $M_P$ of the torque is detected. Instead, the diagram shows that the screw joint continues to rotate over a further angular distance after the torque peak magnitude has been detected. This means that the screw joint is subjected to a further increased clamping force, and that the obtained clamping force level corresponds to a much lower torque magnitude than what is represented by the torque peak level $M_P$. The torque magnitude corresponding to the stopping position of the joint is the installed torque and is designated $M_I$.

In FIG. 3*c*, there is also illustrated the growth of the clamping force F during a torque impulse delivered to the joint. In the diagram of FIG. 3*c*, there is clearly shown that the clamping force F starts increasing as the joint starts rotating and continues to increase until the joint stops rotating, as illustrated by the point $\phi_I$.

The slight wave form of the torque/time curve, i.e. the occurrence of a second lower peak, is due to dynamic forces and elasticity in the power train of the tightening tool.

In FIGS. 4*a–c*, 5*a–c* and 6*a–c* there are shown curves reflecting the rotational movement of the screw joint as well as the detected torque and clamping force magnitudes during three later torque pulses delivered to the joint during the same tightening process. It is clearly shown that the pulses are successively shorter as the joint is further tightened, and that the secondary torque peak tends to merge with the main torque peak as the tightening process approaches the final pretension condition. See FIG. 6*c*.

The four different torque pulses illustrated in FIGS. 3*a–c*, 4*a–c*, 5*a–c* and 6*a–c*, respectively, show clearly by way of examples that the main torque peak value previously used for determining the tightening state of the screw joint does not represent the torque magnitude that corresponds to the obtained clamping force in the joint. Even though at a later tightening stage the rotation stop point $\phi_I$ of each impulse is closer to the torque peak point, there is still a substantial difference between the peak level $M_P$ and the installed torque $M_I$. See FIG. 6*c*.

According to the invention, the per impulse increasing installed torque $M_I$, which is detected at the point where the screw joint rotation ceases at each impulse, is used for determining when the joint is tightened to the predetermined torque target level.

Moreover, in the diagrams shown in FIGS. 3*c*, 4*c*, 5*c* and 6*c*, there is confirmed that the actual clamping force F actually increases over the angular interval determined by the duration of each impulse. Accordingly, it can be seen that the clamping force F increases from the point $\phi_0$ in which the rotation starts to the point $\phi_I$ in which the rotation ceases.

What is claimed is:

1. A method for controlling a screw joint tightening process wherein the screw joint is to be tightened to a predetermined torque level by means of a torque impulse delivering tool, comprising:

measuring an instantaneous value of an applied torque delivered to the screw joint during each one of a number of succeeding torque impulses delivered to the screw joint, detecting continuously a rotational movement of the screw joint during each one of said torque impulses, indicating when the rotational movement of the screw joint ceases at each impulse, indicating a value of the applied torque at the instant the rotational movement of the screw joint ceases at each impulse, comparing the indicated value of the applied torque at cessation of the screw joint rotation for each one of the number of succeeding impulses with said predetermined torque level, and interrupting the tightening process as said indicated value of the applied torque reaches said predetermined torque level.

2. A method for quality checking of a screw joint tightening process performed by a torque impulse delivering power tool, comprising:

measuring an instantaneous torque value as well as an accomplished rotational increment accomplished during each one of a number of succeeding torque impulses delivered by the torque impulse delivering power tool, providing high and low limit values for a final torque and a total angle of rotation, comparing at an end of the tightening process a measured final torque value and a measured total angle of rotation with said limit values, and providing an indication as to whether or not said measured final torque value and said measured total angle of rotation are within said limit values, wherein said final torque value is measured at a very end of the accomplished rotational increment measured during each one of the delivered torque impulses.

3. The method according to claim 2, wherein the rotational increment accomplished during a first impulse of a series of delivered impulses is measured from a point past a predetermined threshold value at a start of the first impulse.

* * * * *